United States Patent [19]

Koch

[11] Patent Number: 4,653,205

[45] Date of Patent: Mar. 31, 1987

[54] SKI BOOT WITH ADJUSTABLE FLEX CONTROL

[75] Inventor: Albin G. Koch, Davos-Dorf, Switzerland

[73] Assignee: Heierling of Switzerland, Ltd., Warwick, R.I.

[21] Appl. No.: 830,932

[22] Filed: Feb. 19, 1986

[51] Int. Cl.[4] ..... A43B 5/04

[52] U.S. Cl. ..... 36/117; 36/121; 24/585

[58] Field of Search ..... 36/117–121, 36/105; 24/580, 585, 617

[56] References Cited

U.S. PATENT DOCUMENTS

| | | | |
|---|---|---|---|
| D. 271,441 | 11/1983 | Salomon et al. . | |
| 3,706,117 | 12/1972 | Axisa | 24/585 X |
| 4,381,613 | 5/1983 | Lederer | 36/121 |
| 4,455,768 | 6/1984 | Salomon | 36/121 |
| 4,513,520 | 4/1985 | Koch . | |
| 4,577,420 | 3/1986 | Petrini et al. | 36/117 |

FOREIGN PATENT DOCUMENTS

| | | | |
|---|---|---|---|
| 0172159 | 2/1986 | European Pat. Off. | 36/117 |
| 2539278 | 7/1984 | France | 36/117 |
| 2564710 | 11/1985 | France | 36/117 |

*Primary Examiner*—James Kee Chi

*Attorney, Agent, or Firm*—Roylance, Abrams, Berdo & Goodman

[57] ABSTRACT

A ski boot with adjustable flex control includes a substantially rigid cuff portion and a substantially rigid boot portion pivotally coupled to a lower portion of the cuff portion. A groove defined between the cuff and boot portions receives a movable cursor whose movement along the length of the groove varies the flexure characteristics of the boot. The cursor is wholly located within the groove for shielding by the cuff and boot portions from engaging a ski. A detent mechanism within the cursor engages recesses in the groove to lock the cursor selectively in a series of discrete, predetermined positions. The detent mechanism comprises a spring biased bolt member mounted in a bore and movable axially within the cursor such that the bolt mechanism and its movement are wholly located within the groove. The locking and unlocking operations are accomplished by axial movement of the bolt member.

16 Claims, 10 Drawing Figures

SKI BOOT WITH ADJUSTABLE FLEX CONTROL

FIELD OF THE INVENTION

The present invention relates to a ski boot having a rigid cuff portion and a rigid boot portion pivotally coupled to a lower portion of the cuff portion. The flexure of the ski boot provided by this pivotal coupling is adjusted by movement of a cursor or cursors located within a groove defined between the cuff and boot portions.

BACKGROUND OF THE INVENTION

Most ski boots are currently constructed from a substantially rigid outer shell formed of plastic and a substantially flexible inner boot received in the outer shell. The inner boot is formed of foam plastic covered with leather or rubber. This construction, due to the rigidity of the outer shell, has been a vast improvement over the prior all leather ski boots, which allowed large amounts of relative movement between the foot and the boot. Typical examples of these type of boots are disclosed in Applicant's prior patent, U.S. Pat. No. 4,513,520 and the patents cited therein. The subject matter of Applicant's prior patent is hereby incorporated by reference.

With this type of boot, it has now become necessary to provide flexure characteristics which can be eaily adjusted by the skier. Boots having flexional characteristics adjustable by the skier without opening the boot are disclosed in U.S. Pat. No. 4,455,768 to Salomon. The Salomon patent discloses ski boots having a groove between its cuff and boot portions receiving a cursor movable along the length of the groove to vary the flexional characteristics. The subject matter of the Salomon patent is hereby incorporated by reference.

However, the cursor arrangements disclosed in the Salomon patent are disadvantageous in that they protrude outwardly from the groove creating a protuberance which can come in contact with the ski mounted on the skier's opposite foot. This contact can cause damage both to the cursor arrangement and to the ski edge, as well as interfering with the skiing. Moreover, the mechanisms disclosed in the Salomon patent for locking the cursor in position are unduly complex and difficult to manufacture and to operate. The operation is particularly difficult when the skier attempts to unlock the cursor, move it to the desired position and relock it in position while wearing heavy gloves.

SUMMARY OF THE INVENTION

Accordingly, an object of the present invention is to provide a ski boot with adjustable flexure characteristics provided by a cursor slidable within a groove between the cuff and boot portions, which cursor does not protrude beyond the outer periphery of the groove or provide a protuberance on the boot.

Another object of the present invention is to provide a ski boot with adjustable flexure characteristics provided by a cursor slidable in a groove between the cuff and boot portions and having a latching mechanism which is simple and inexpensive to manufacture and operate, and is of rugged construction.

The foregoing objects are basically obtained by ski boot comprising a substantially rigid cuff portion and a substantially rigid boot portion pivotally coupled to a lower portion of the cuff portion. The cuff portion and the boot portion have support members which are generally parallel and define an elongated groove between them. The groove has a base surface, a groove longitudinal axis and an outer periphery defined by the outer surfaces of the cuff portion and the boot portion. A cursor is mounted in the groove for movement along its length, and has an inner surface in contact with the base surface. An outermost surface of the cursor, opposite its inner surface, is located wholly within the outer periphery of the groove such that the cursor does not extend outside of the groove.

By forming the ski boot in this manner, the flexure characteristics of the ski boot can be easily varied by moving the cursor to various positions in the groove. By locating the cursor wholly within the groove, the cursor is shielded by the cuff portion and the boot portion to prevent direct contact between the cursor and the ski on the skier's opposite foot.

The foregoing objects are also obtained by a ski boot comprising a substantially rigid cuff portion and a substantially rigid boot portion pivotally coupled to a lower of the cuff portion. The cuff portion and boot portion have support members which are generally parallel and define elongated groove between them with a groove longitudinal axis. A cursor is mounted in the groove for movement along the length of the groove. One of the support members has a plurality of recesses opening into the groove. A detent arrangement is provided in the cursor and is movable into and out of the recesses for locking the cursor in a desired position. The detent arrangement has an elongated bolt member having a longitudinal bolt axis extending substantially parallel to the groove axis and axially slidable in the cursor. A latch member is mounted for movement into and out of the recesses in response to the axial movement of the bolt member.

By forming the ski boot in this manner, the flexure characteristics of the ski boot can be easily varied by moving the cursor to various portions in the groove. The locking mechanism provided by the detent arrangement is simple to operate, even by a skier wearing gloves, and is simple and inexpensive to manufacture.

Other objects, advantages and salient features of the present invention, will become apparent from the following detailed description, which, taken in conjunction with the annexed drawings, discloses a preferred embodiment of the invention.

BRIEF DESCRIPTION OF THE DRAWINGS

Referring to the drawings which form a part of this original disclosure.

DETAILED DESCRIPTION OF THE PREFERRED EMBODIMENT

Figure 1:
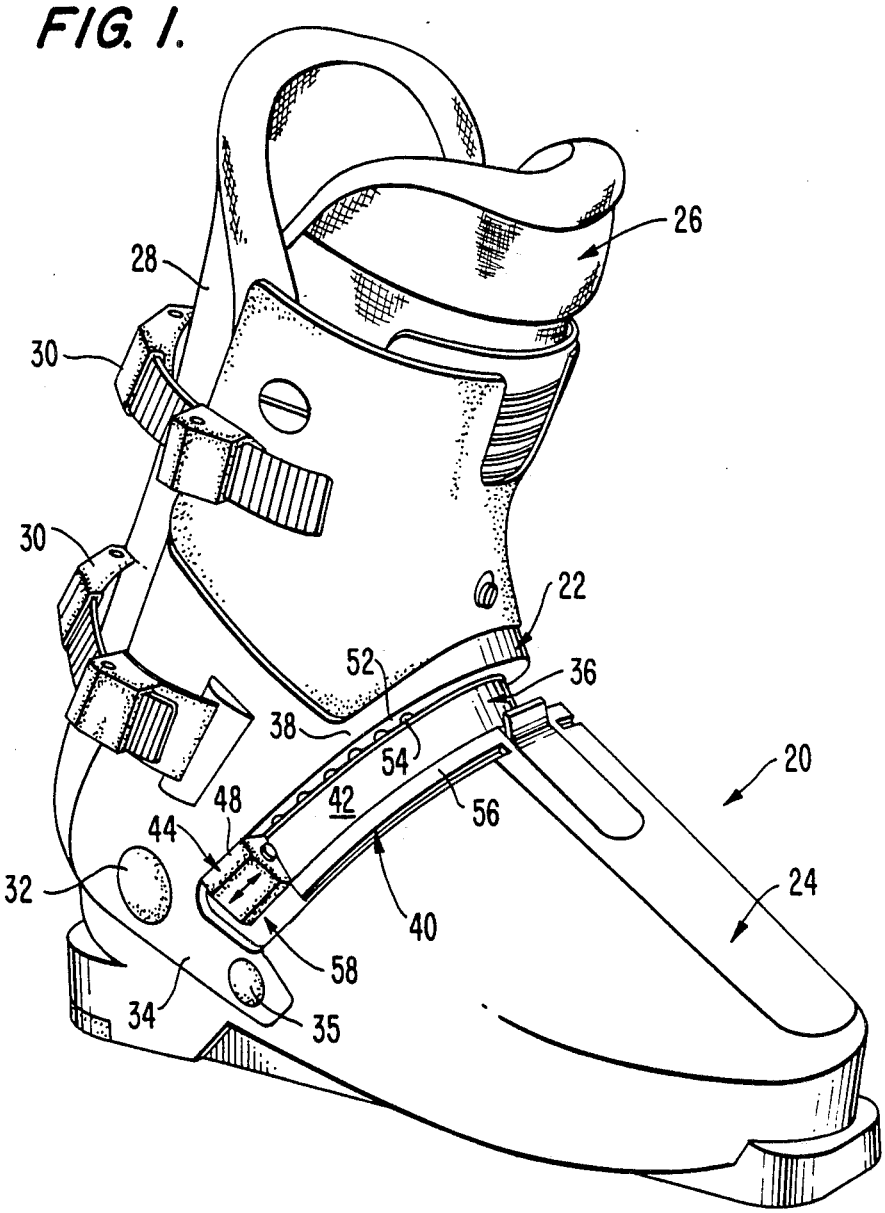
FIG. 1 is a front and side perspective view of a ski boot in accordance with the present invention.
Figure 2:
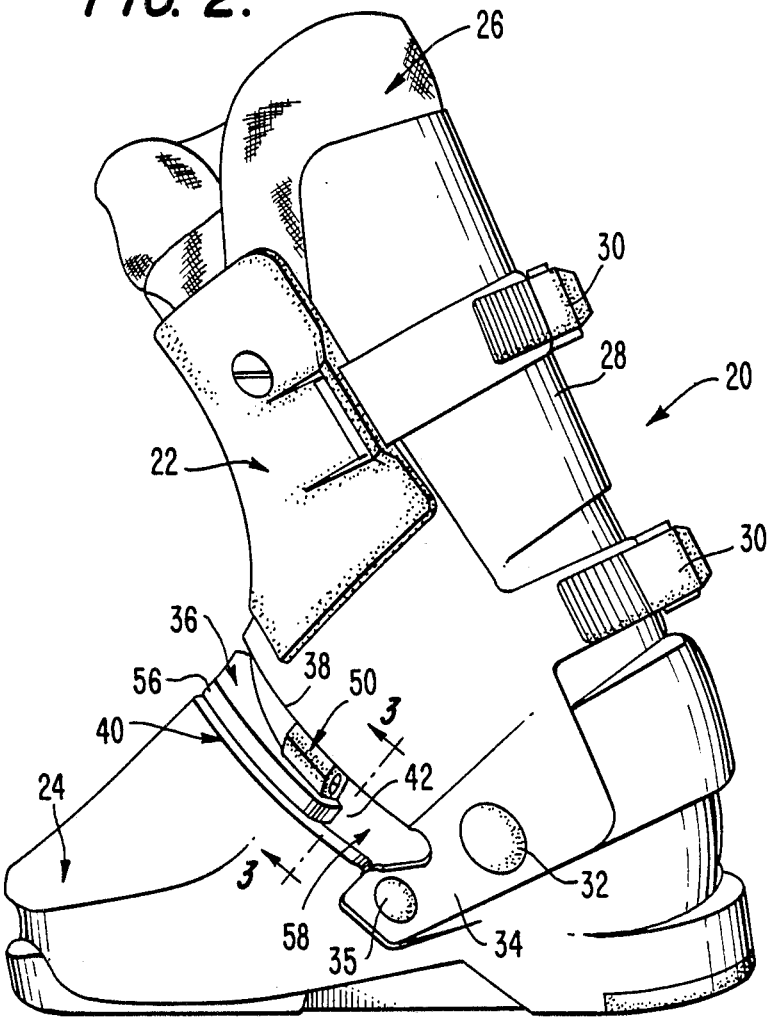
FIG. 2 is a rear, opposite side perspective view of the ski boot of FIG. 1.

Referring initially to FIGS. 1 and 2, the present invention comprises a ski boot 20 having a substantially rigid cuff portion 22 and a substantially rigid boot portion 24. A soft inner boot 26 is located within the cuff and boot portions. A rear panel 28 is coupled to cuff portion 22 by buckles 30 to permit entry of inner boot 26 and to secure the inner boot inside the cuff and boot portions.

Boot portion 24 is pivotally coupled to a lower portion of cuff portion 22 by journal 32. The pivotting action provided by journals 32 and the resistance to such pivotting by the flexible characteristics of extensions 34 and by the second rivets 35 define the minimum flexible resistance to pivotting in the ski boot. This double rivet arrangement is disclosed in U.S. Pat. No. Des. 271,441 to Salomon.

A groove 36 is defined between cuff portion 22 and boot portion 24 by cuff support member 38 and boot support member 40. The groove is elongated, follows the contour of the ski boot across the top of the ski boot between the journals 32, and has a curved longitudinal axis. A base surface 42 defines the bottom of the groove and extends between support members 38 and 40. The outer periphery of the groove is defined by the curved outer surfaces of cuff portion 22 and boot portion 24 adjacent to the groove and defining the support members 38 and 40.

Figure 3:
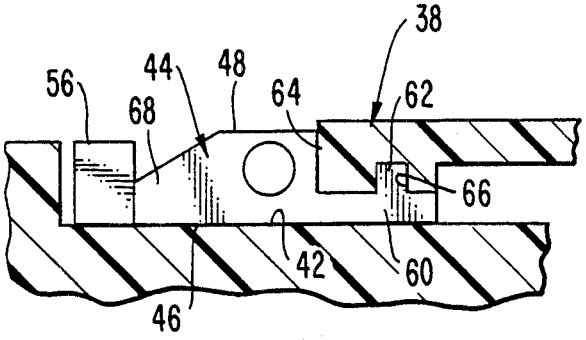
FIG. 3 is a partial, side elevational view in section of the ski boot of FIG. 1 taken along lines 3—3 of FIG. 2.
Figure 8:
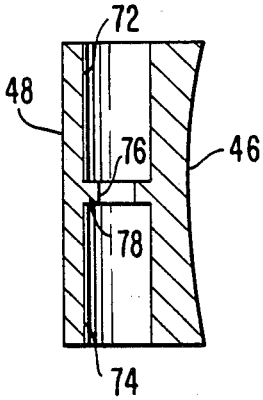
FIG. 8 is a side elevational view in section taken along lines 8—8 of FIG. 7.
Figure 9:
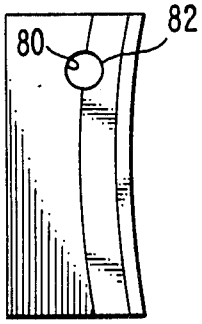
FIG. 9 is a side elevational view of the cursor of FIG. 6.

A cursor 44 is mounted in the groove for movement along the its longitudinal axis or its length. The cursor has a curved inner surface 46 (see FIGS. 3 and 8) conforming to and engaging base surface 42. The cursor has an outermost surface 48, opposite inner surface 46, which is wholly located within the periphery of the groove as defined by the outer surfaces of the cuff portion and the boot portion. In this manner, the cursor does not extend outside of the groove and is shielded by the cuff and boot portions.

The flexure characteristics of the boot are varied by locating cursor 44 in different positions within groove 36. The higher the cursor is moved within the groove, the greater the resistance to flexing. Conversally, the lower the cursor is moved within the groove, i.e., towards journals 32, the less is the resistance to flexing.

Cursor 44 is provided generally on the in-step portion of the ski boot. A second cursor 50 (see FIG. 2) is located on the outer portion of the ski boot. Since the two cursors are essentially identical, only one will be described in detail, since the description of one will also apply to the other.

Support member 38 includes a generally vertical edge surface 52 defining one side of the groove. This edge surface comprises a plurality of recesses 54 which define various discrete positions for the cursor along the groove. The opposite side of the groove, defined by support member 40, includes a bar member 56 terminating short of the lower end 58 of groove 36. In this manner, an enlarged lower end of the groove is provided, which lower end is defined between the cuff portion 22 and the boot portion 24. The width of the groove between surface 52 and bar member 56 is substantially equal to the corresponding width of the cursor part in the groove. The width at the enlarged lower end 58 is greater than the cursor part width in the groove to facilitate maximum flexing with the cursor located in its lowermost position, as illustrated in FIG. 1.

As illustrated in FIGS. 3–9, the cursor includes a lateral extension with a curved ridge 62. The extension and ridge conform to a curved projection 64 extending inwardly on support member 38. Projection 64 contains a groove 66 receiving ridge 62. This arrangement provides a tongue and groove connection between the cursor and the cuff portion to positively and securely retain the cursor within the groove, while permitting free sliding motion of the cursor within the groove.

Figure 10:
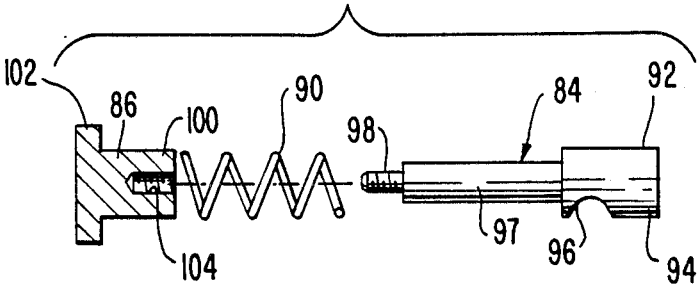
FIG. 10 is an exploded side elevational view, partially in section, of the locking bolt of the ski boot of FIG. 1.

The cursor includes a detent mechanism which releasably engages recesses 54 in edge surface 52 to lock the cursor in a desired position along the longitudinal axis of groove 36. The detent mechanism is particularly illustrated in FIGS. 4, 5 and 10. Details of the structure of the cursor housing 68 are more particularly illustrated in FIGS. 6–9.

Referring to FIGS. 6–9, cursor housing 68 for the detent mechanism is attached to an end of extension 60. The housing includes an axial bore 70 having cylindrical end sections 72 and 74 and a prismatic intermediate section 76. The prismatic section 76 is square in transverse cross section and is defined by a square opening within a radial flange 78 located between the two cylindrical end sections 72 and 74. A laterally extending cylindrical bore 80 is provided in the housing such that it communicates with cylindrical end section 72. A recess 82 is formed in ridge 62 coaxial with bore 80 to facilitate formation of bore 80.

The detent mechanism or arrangement mounted within cursor housing 68 includes a bolt member 84, a head member 86, a spherical ball detent 88, and a tension spring 90. The bolt member includes an enlarged cylindrical end 92 with a projection 94 and a depression 96. A rod 97 in the shape of a parallelipiped or rectangular solid extends from the axial end of cylindrical end 92 adjacent depression 96. An externally threaded portion 98 extends from rod 97 at its end opposite cylindrical end 92. Head member 86 comprises a base 100 and a radial flange 102. Both base 100 and flange 102 have cylindrical lateral surfaces. An internally threaded bore 104 is provided in base 100 for releasably coupling rod 97 and head member 86 by the treaded engagement of portion 98 and bore 104.

Figure 4:
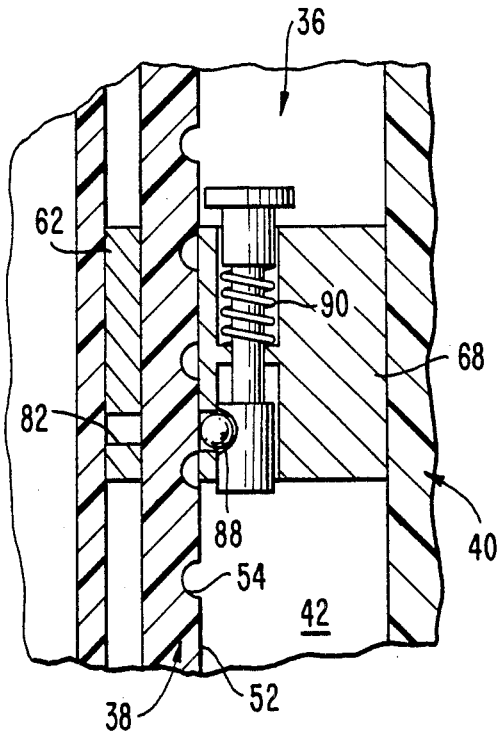
FIG. 4 is a partial, plan view in section of the locking arrangement of the ski boot of FIG. 1 in the unlocked position.
Figure 5:
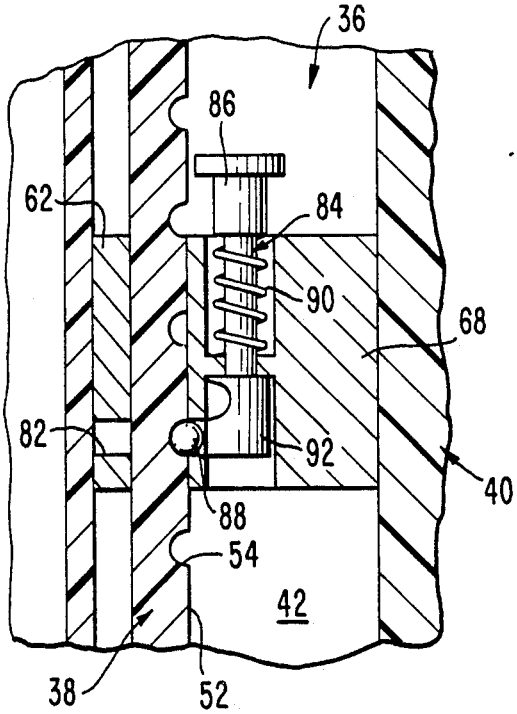
FIG. 5 is a partial, top plan view in section of the locking arrangement of FIG. 4 in the locked position.
Figure 6:
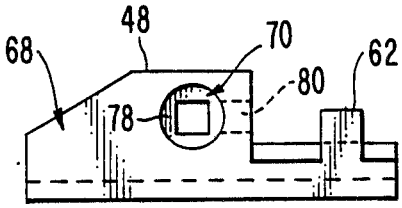
FIG. 6 is an end elevational view of the cursor of the ski boot of FIG. 1.
Figure 7:
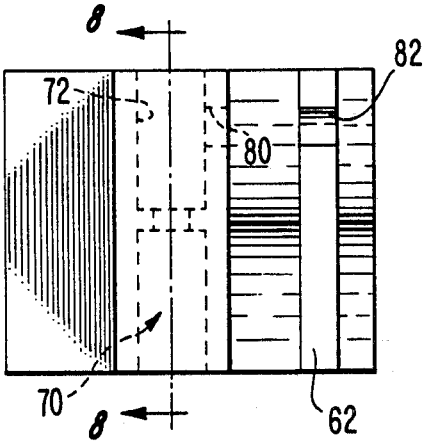
FIG. 7 is a top plan view of the cursor of FIG. 7.

Spring 90 is sized to fit over rod 97 and to be trapped in bore cylindrical end section 74, with its axial ends engaging the axial end of base 100 of head member 96 and flange 78 as illustrated in FIGS. 4 and 5. Cylindrical end 92 is slidably received in cylindrical end section 72 of bore 70, while head base 100 can be slidably received within end section 74. Spring 90 biases the bolt member to an upper position as illustrated in FIG. 5, but permits the bolt member to be depressed within housing 68 as illustrated in FIG. 4.

Ball detent 88 forms a latch member that moves in and out of recesses 54 to releasably lock cursor 44 and cuff support member 38. With the bolt member depressed, as illustrated in FIG. 4, depression 96 is located directly adjacent bore 80 such that the depression is in the axis of bore 80. This permits ball detent 88 to be retracted within cursor housing 68 and out of one of the recesses 54 such that the cursor can be easily moved along groove 36. If the ball detent is initially located within a recess, movement of the cursor with the bolt member in the depressed position will force the ball detent into the housing.

When the bolt member is released, the spring moves the bolt member upwardly forcing ball detent 88 through bore 80 so as to protrude laterally from cursor housing 68. As illustrated in FIG. 5, when the ball detent is located opposite one of the recesses 54, ball detent 88 can be received within the recess to an extent sufficient to positively lock the cursor in the desired position. Projection 94 is then located laterally adjacent the ball detent and in the axis of bore 80 to prevent the ball detent from being withdrawn from the recess without movement of the bolt member. Thus, the projection prevents withdrawal of the ball detent from the recess.

The elongated bolt member 86, bore 70 in which the bolt member is mounted and the axial movement of the bolt member in housing 68 are substantially parallel to and within the lateral confines of groove 36. This arrangement facilitates movement of the detent mechanism by the skier's glove hand, and protects the detent mechanism from contacting a ski. The sliding engagement of rod 97 and intermediate section 76 prevents relative rotation of the bolt member within bore 70. This ensures the proper rotational attitude of depression 96 facing bore 80 to ensure proper operation of the detent mechanism.

In operation, the cursor and detent mechanism are initially located in the positions illustrated in FIG. 5, with the bolt member in an extended position and the ball detent 88 located in a recess 54. To move the cursor to another position to change the flexure characteristics of the ski boot, bolt member 84 is depressed by applying a force on the top of head member 86 such that depression 96 is located adjacent bore 80 and ball detent 88. Movement of the cursor in either direction along groove 36 will force ball detent 88 out of the recess 54 and into cursor housing 68 to permit free sliding movement of the cursor.

When the cursor is located in the desired position, the bolt member is released by the skier to permit it to move under the bias of spring 90 enabling the ball detent to be forced into the appropriate recess 54. When the ball detent enters the recess, the bolt member will return to the position illustrated in FIG. 5 such that projection 94 will prevent the ball detent from being withdrawn from recess 54. Each of the two cursors 44 and 50 can be operated independently in this manner.

While a particular embodiment has been chosen to illustrate the invention, it will be understood by those skilled in the art that various changes and modifications can be made therein without departing from the scope of the invention as defined in the appended claims.

What is claimed is:

1. A ski boot, comprising:

a substantially rigid cuff portion having a first curved outer surface and a first support member;

a substantially rigid boot portion pivotally coupled to a lower portion of said cuff portion, said boot portion having a second curved outer surface and a second support member, said support members being generally parallel and defining an elongated groove therebetween, said groove having a base surface between said support members, a groove longitudinal axis, and an outer periphery defined by said outer surfaces; and a cursor mounted in said groove for movement along a length thereof, said cursor having an inner surface in contact with said base surface and an outermost surface, opposite said inner surface, wholly within said outer periphery of said groove, such that no portion of said cursor extends outside of said groove;

whereby, flexure characteristics of the ski boot can be varied by moving said cursor to various positions in said groove, and said cursor is shielded by said cuff portion and said boot portion.

2. A ski boot according to claim 1 wherein one of said support members comprises a plurality of recesses opening into said groove; and said cursor comprises a detent means, movable into and out of said recesses, for locking said cursor in position.

3. A ski boot according to claim 2 wherein said detent means comprises an elongated bolt member having a longitudinal bolt axis extending substantially parallel to said groove axis and axially slidable in said cursor, and a latch member mounted for movement into and out of said recesses in response to axial movement of said bolt member.

4. A ski boot according to claim 3 wherein said bolt member is biased by a spring towards a position forcing said latch member into one of said recesses.

5. A ski boot according to claim 4 wherein said bolt member comprises a depression and a projection selectively locatable adjacent said latch member upon axial movement of said bolt member, said latch member being receivable in said depression to allow withdrawal of said latch member from one of said recesses and into said cursor, said projection being engagable with said latch member preventing withdrawal of said latch member from one of said recesses and locking said cursor in a desired position in said groove.

6. A ski boot according to claim 5 wherein said bolt member is received in a bore in said cursor, said bore having means preventing rotation of said bolt member about said longitudinal axis thereof.

7. A ski boot according to claim 1 wherein said cursor and one of said cuff portion and said boot portion are slidably engaged by a tongue and groove arrangement.

8. A ski boot according to claim 1 wherein said groove has an enlarged width at a lowermost portion thereof where said cursor is spaced from one of said support members.

9. A ski boot, comprising:

a substantially rigid cuff portion having a first support member;

a substantially rigid boot portion pivotally coupled to a lower portion of said cuff portion, said boot portion having a second support member, said support members being generally parallel and defining an elongated groove therebetween with a groove longitudinal axis;

a cursor mounted in said groove for movement along a length thereof, one of said support members having a plurality of recesses opening into said groove; and detent means for locking said cursor in position, said detent means having an elongated bolt member with a longitudinal bolt axis extending substantially parallel to said groove axis and axially slidable in said cursor, and having a latch member mounted for movement into and out of said recesses in response to axial movement of said bolt member;

whereby, flexure characteristics of the ski boot can be varied by moving said cursor to various positions in said groove.

10. A ski boot according to claim 9 wherein said bolt member is biased by a spring towards a position forcing said latch member into one of said recesses.

11. A ski boot according to claim 10 wherein said bolt member comprises a depression and a projection selectively locatable adjacent said latch member upon axial movement of said bolt member, said latch member being receivable in said depression to allow withdrawal of said latch member from one of said recesses and into said cursor, said projection being engagable with said latch member preventing withdrawal of said latch member from one of said recesses and locking said cursor in a desired position in said groove.

12. A ski boot according to claim 11 wherein said bolt member is received in a bore in said cursor, said bore having means preventing rotation of said bolt member about said longitudinal axis thereof.

13. A ski boot according to claim 9 wherein said cursor and one of said cuff portion and said boot portion are slidably engaged by a tongue and groove arrangement.

14. A ski boot according to claim 9 wherein said groove has an enlarged width at a lowermost portion thereof where said cursor is spaced from one of said support members.

15. A ski boot according to claim 10 wherein one end of said bolt is exposed in said groove for sliding said bolt axially in said cursor against biasing of said spring by pushing on said one end.

16. A ski boot according to claim 4 wherein one end of said bolt is exposed in said groove for sliding said bolt axially in said cursor against biasing of said spring by pushing on said one end.

* * * * *